US008189021B2

(12) United States Patent
Morooka et al.

(10) Patent No.: US 8,189,021 B2
(45) Date of Patent: May 29, 2012

(54) THERMAL HEAD MANUFACTURING METHOD, THERMAL HEAD, AND PRINTER

(75) Inventors: Toshimitsu Morooka, Chiba (JP); Keitaro Koroishi, Chiba (JP); Yoshinori Sato, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 279 days.

(21) Appl. No.: 12/589,593

(22) Filed: Oct. 26, 2009

(65) Prior Publication Data

US 2010/0118105 A1 May 13, 2010

(30) Foreign Application Priority Data

Oct. 27, 2008 (JP) ..... 2008-276054

(51) Int. Cl.
*B41J 2/335* (2006.01)

(52) U.S. Cl. ..... 347/206

(58) Field of Classification Search ..... 347/206, 347/200, 204–205, 208–209
See application file for complete search history.

(56) References Cited

U.S. PATENT DOCUMENTS

| | | | | |
|---|---|---|---|---|
| 6,335,750 | B2 * | 1/2002 | Horiuchi et al. | 347/200 |
| 6,525,755 | B1 * | 2/2003 | Imai et al. | 347/208 |
| 7,843,476 | B2 * | 11/2010 | Morikawa et al. | 347/209 |
| 2001/0033320 | A1 * | 10/2001 | Sugiyama et al. | 347/206 |

FOREIGN PATENT DOCUMENTS

| | | |
|---|---|---|
| EP | 1834794 | 9/2007 |
| JP | 60006478 | 1/1985 |
| JP | 6166197 | 6/1994 |
| JP | 2008207529 | 9/2008 |

* cited by examiner

*Primary Examiner* — Kristal Feggins
(74) *Attorney, Agent, or Firm* — Adams & Wilks

(57) ABSTRACT

A thermal head manufacturing method comprises a concave portion forming step of forming a concave portion on one surface of a supporting substrate, a bonding step of bonding a thin plate glass to the one surface of the supporting substrate where the concave portion has been formed in a manner that hermetically seals the concave portion and forms a hollow portion, a heating step of heating the supporting substrate and the thin plate glass which have been bonded together in the bonding step to thereby soften the thin plate glass and expand gas trapped inside the hollow portion, and a heating resistor forming step of forming a heating resistor on the thin plate glass so as to be opposed to the hollow portion. During the heating step, the thin glass plate undergoes plastic deformation, due to expansion of the gas inside the hollow portion, and rises toward an opposite side from the hollow portion, and a leveling step is carried out to level the outer surface of the plastically deformed thin glass plate.

4 Claims, 12 Drawing Sheets

THERMAL HEAD MANUFACTURING METHOD, THERMAL HEAD, AND PRINTER

BACKGROUND OF THE INVENTION

1. Field of the Invention

The present invention relates to a thermal head, a printer, and a thermal head manufacturing method.

2. Description of the Related Art

There have been conventionally known a thermal head which is used in a thermal printer often installed to a portable information equipment terminal typified by a compact hand-held terminal, and which is used to perform printing on a thermal recording medium based on printing data with the aid of selective driving of a plurality of heating elements (for example, see Patent Document JP 2007-320197 A).

In terms of an increase in efficiency of the thermal head, there is a method of forming a heat insulating layer below a heating portion of a heating resistor. By formation of the heat insulating layer below the heating portion, of an amount of heat generated in the heating resistor, an amount of upper-transferred heat which is transferred to an abrasion resistance layer formed above the heating portion becomes larger than an amount of lower-transferred heat which is transferred to a heat storage layer formed below the heating portion, and hence energy efficiency required during printing can be sufficiently obtained. In the thermal head described in Patent Document JP 2007-320197 A, a hollow portion is provided between an upper substrate and a lower substrate which are integrated, and this hollow portion functions as a hollow heat insulating layer. Thus, the amount of upper-transferred heat becomes larger than the amount of lower-transferred heat, and the energy efficiency is increased.

Further, in a printer in which a thermal head is installed, thermal paper is pressed, with a predetermined pressing force, against a head portion formed above the heating portion by a platen roller. Therefore, the thermal head is required to have heating efficiency for improving printing quality as described above, and required to have strength for withstanding the pressing force of the platen roller.

Increasing the thickness dimension of the hollow portion by making the heat storage layer, which supports the heating resistors, thin enhances the heat insulation performance and improves the heating efficiency proportionally. On the other hand, as the thickness of the heat storage layer is reduced, the strength for supporting the heating resistors is reduced. The heat storage layer should therefore be set to a desired thickness in order to improve the heating efficiency and strength of the thermal head.

Patent Document 1 describes a thermal head manufacturing method in which the hollow portion is formed by forming a gap within a convex portion, which is formed on one surface of the upper substrate, and closing up the gap through fusion-bonding of the flat lower substrate to the other surface of the upper substrate. There is a possibility with this manufacturing method that, if a load is applied upon bonding to a surface of the upper substrate softened by fusion, the convex portion of the upper substrate is deformed to cause fluctuations in the thickness of the upper substrate, namely, the heat storage layer. The resultant problem is that stable manufacture of a thermal head improved in heating efficiency and strength is difficult.

SUMMARY OF THE INVENTION

The present invention has been made in view of the above-mentioned circumstances, and an object of the present invention is therefore to provide a thermal head, a printer, and a thermal head manufacturing method capable of manufacturing stably the thermal head, in which improvements in heating efficiency and strength are achieved.

In order to achieve the above-mentioned object, the present invention provides the following means.

The present invention provides a thermal head manufacturing method comprising: a concave portion forming step of forming a concave portion on one surface of a supporting substrate; a bonding step of bonding an upper substrate, which is made of glass shaped like a substantially flat board, to the one surface of the supporting substrate where the concave portion has been formed in the concave portion forming step, in a manner that hermetically seals the concave portion and forms a hollow portion; a heating step of heating the supporting substrate and the upper substrate which have been bonded together in the bonding step, to thereby soften the upper substrate and expand gas trapped inside the hollow portion; and a heating resistor forming step of forming a heating resistor on the upper substrate so as to be opposed to the hollow portion, wherein the heating step concavely curves a surface of the upper substrate that is on the hollow portion side.

The upper substrate placed directly under the heating resistor functions as a heat storage layer. The hollow portion functions as a hollow heat insulating layer to prevent heat generated in a heating portion of the heating resistor from being transmitted to the supporting substrate through an intermediation of the heat storage layer. According to the present invention, the heating step curves the hollow portion side surface of the upper substrate into a concave shape, thereby increasing the thickness dimension of the hollow heat insulating layer and enhancing the heat insulation performance. A thermal head high in heating efficiency is thus manufactured.

The use of an upper substrate shaped like a substantially flat board in this case makes it possible to apply a substantially uniform load to a surface opposite to the hollow portion side surface (hereinafter referred to as "heating resistor side surface") in the bonding step. This eliminates the inconvenience of conventional upper substrates having a convex portion on their heating resistor side surfaces in which the convex portion is deformed from a load applied upon bonding to cause fluctuations in the shape of the heating resistor side surface. As a result, a thermal head easier to set the heat storage layer to a desired thickness and improved in heating efficiency and strength can be manufactured stably. Examples of employable method of bonding the supporting substrate and the upper substrate together include anodic bonding and bonding with the use of an adhesive.

According to the present invention described above, in the heating step, the upper substrate may be deformed by plastic deformation so as to rise up toward an opposite side from the hollow portion.

With this structure, a thermal head can be manufactured that has a heat storage layer deformed so as to protrude toward the outside of the hollow portion, in other words, deformed so as to rise up toward the heating resistor side.

Further, the present invention described above may include a leveling step of leveling a surface of the upper substrate which has been deformed by plastic deformation in the heating step that is opposite from the hollow portion.

With this structure, the heating resistor can be formed on the leveled upper substrate in the heating resistor forming step, thus making it easier to level the heating portion of the heating resistor which comes into contact with an object to be printed. Examples of employable processing methods for leveling the surface of the upper substrate include polishing.

Further, according to the present invention described above, in the heating step, deformation of a surface of the upper substrate that is opposite from the hollow portion may be controlled.

With this structure, a thermal head having a heat storage layer that is substantially flat on its heating resistor side surface can be manufactured efficiently.

The present invention provides a thermal head manufacturing method, comprising: a concave portion forming step of forming a concave portion on one surface of a supporting substrate; a bonding step of bonding by heat fusion an upper substrate, which is made of glass shaped like a substantially flat board, to the one surface of the supporting substrate where the concave portion has been formed in the concave portion forming step, in a manner that hermetically seals the concave portion and forms a hollow portion; and a heating resistor forming step of forming a heating resistor on the upper substrate so as to be opposed to the hollow portion, wherein the bonding step concavely curves a surface of the upper substrate that is on the hollow portion side by utilizing expansion of gas trapped inside the hollow portion and softening of the upper substrate during the heat fusion.

According to the present invention, an upper substrate shaped like a substantially flat board can be used and there is no need for an additional step of curving a surface of the upper substrate. The number of manufacturing steps is therefore reduced, and a thermal head improved in heating efficiency and strength can be manufactured in a simple and stable manner.

According to the present invention described above, in the bonding step, the upper substrate may be deformed by plastic deformation so as to rise up toward an opposite side from the hollow portion.

Further, the present invention described above may include a leveling step of leveling a surface of the upper substrate which has been deformed by plastic deformation in the bonding step that is opposite from the hollow portion.

Further, according to the present invention described above, in the bonding step, deformation of a surface of the upper substrate that is opposite from the hollow portion may be controlled.

The present invention provides a thermal head comprising: a supporting substrate which has a concave portion on a surface; an upper substrate made of glass which is bonded to the surface of the supporting substrate to hermetically seal the concave portion and form a hollow portion; and a heating resistor which is provided on the upper substrate so as to be opposed to the hollow portion, wherein the upper substrate is deformed by expansion of gas within the hollow portion and softening of the upper substrate from heating, so that a substantially flat shape of the upper substrate is deformed to protrude toward the heating resistor side.

According to the present invention, the hollow portion functions as a hollow heat insulating layer to prevent heat generated by the heating resistor from being transmitted to the supporting substrate through the upper substrate, namely, the heat storage layer. This increases the amount of heat conducted upward above the heating resistor to be used for printing or the like, thereby improving the heat efficiency.

This also increases the thickness dimension of the hollow portion and improves the heat insulation performance compared to the case where the hollow portion side surface of the upper substrate is flat. In addition, with the heating portion of the heating resistor rising up to form a convex shape, a better contact with an object to be printed is accomplished. The heat transmission efficiency is thus enhanced.

The present invention provides a thermal head comprising: a supporting substrate which has a concave portion on a surface; an upper substrate made of glass which is bonded to the surface of the supporting substrate to hermetically seal the concave portion and forma hollow portion; and a heating resistor which is provided on the upper substrate so as to be opposed to the hollow portion, wherein the upper substrate comprises a hollow portion side surface, which is deformed from a substantially flat shape into a concavely curved shape by expansion of gas within the hollow portion and softening of the upper substrate from heating, and a heating resistor side surface, which is made substantially flat.

According to the present invention, the heating portion of the heating resistor is substantially flat in conformity with the substantially flat shape of the heating resistor side surface of the upper substrate, and therefore creates less friction with an object to be printed. The amount of wear of the heating portion is thus reduced and the durability is improved while high heat insulation performance is maintained.

The present invention provides a printer comprising: the thermal head according to the present invention described above; and a pressurizing mechanism which presses an object to be printed against the heating resistor of the thermal head.

According to the present invention, the thermal head is high in heating efficiency and less power is consumed in printing on an object to be printed. Further, the thickness of the heat storage layer fluctuates little, which substantially uniformizes the contact pressure between the heating resistor and an object to be printed, and makes excellent quality printing possible with low power.

An effect of the present invention is that a thermal head and a printer improved in heating efficiency and strength are provided, and that the thermal head can be manufactured stably.

DETAILED DESCRIPTION OF THE PRESENT INVENTION

First Embodiment

A thermal printer (printer) 10 and a thermal head 1 according to a first embodiment of the present invention, and a manufacturing method A of the thermal head 1 as well, are described below with reference to the drawings.

Figure 1:
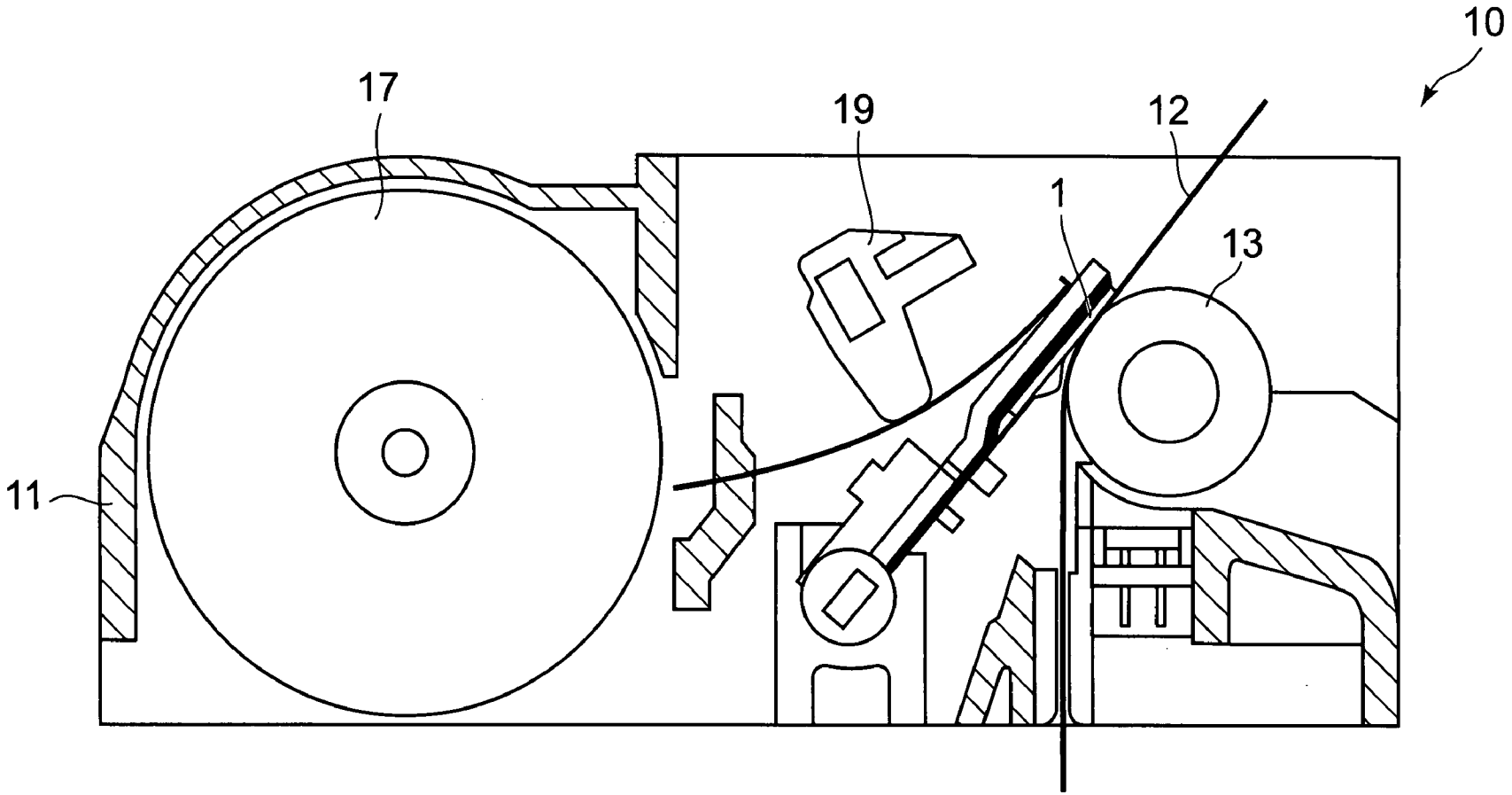
FIG. 1 is a schematic view of a structure illustrating a thermal printer according to a first embodiment of the present invention.

The thermal printer 10 according to this embodiment includes: as illustrated in FIG. 1, a main body frame 11; a platen roller 13 arranged horizontally; the thermal head 1 arranged oppositely to an outer peripheral surface of the platen roller 13; a heat dissipation plate 15 (see FIG. 3) supporting the thermal head 1; a paper feeding mechanism 17 for feeding between the platen roller 13 and the thermal head 1 an object to be printed such as thermal paper 12; and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. With this, load of the platen roller 13 is applied to the thermal head 1 through an intermediation of the thermal paper 12.

The heat dissipation plate 15 is a plate-shaped member made of metal such as aluminum, a resin, ceramics, glass, or the like, and serves for fixation and heat dissipation of the thermal head 1.

Figure 2A:
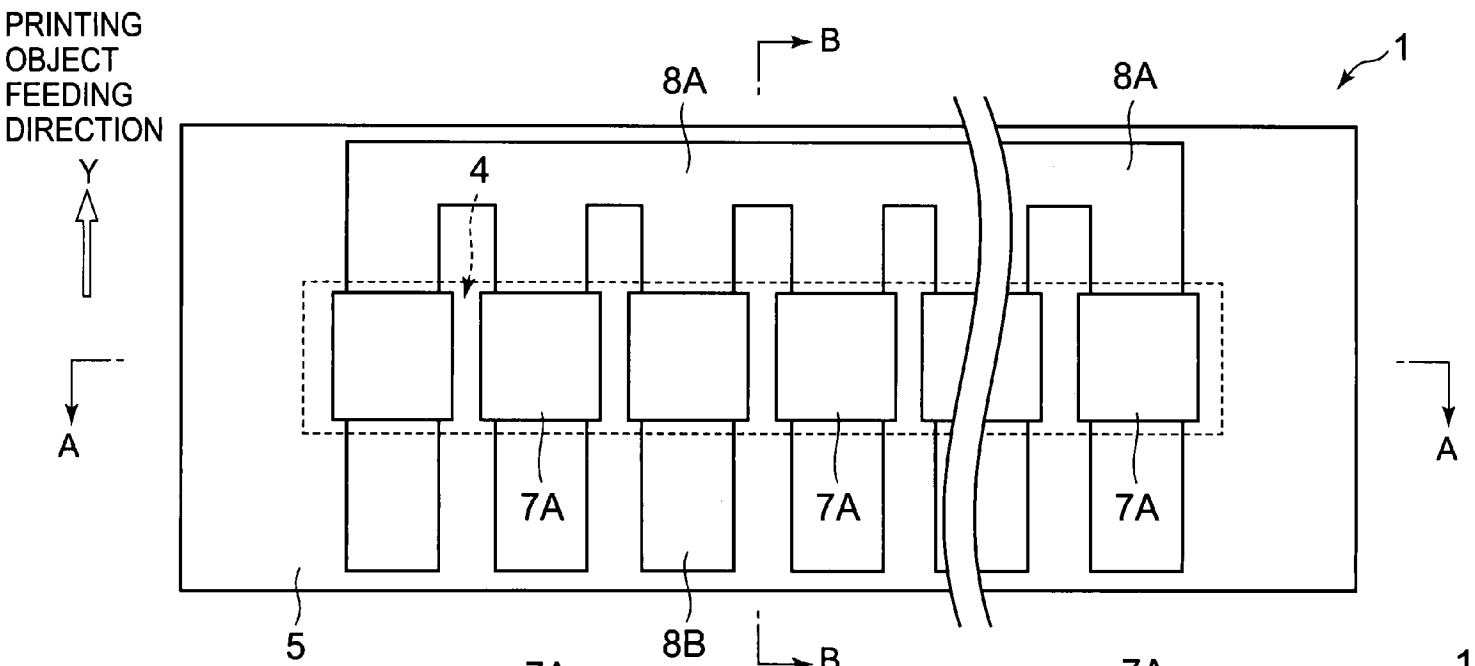
FIG. 2A is a plane view of a thermal head of FIG. 1 as seen from a protective film side.
Figure 2B:
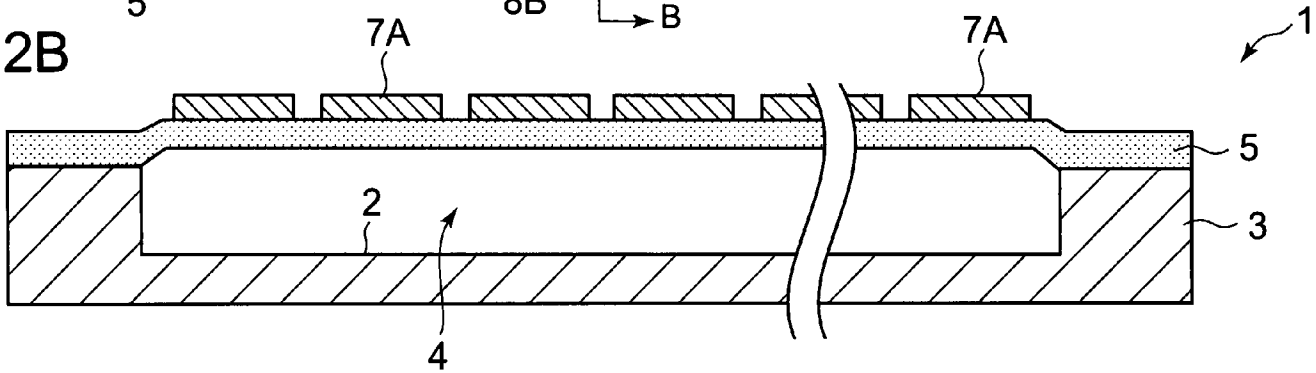
FIG. 2B is a sectional view (lateral sectional view) of the thermal head of FIG. 2A taken along the arrow A-A.
Figure 3:
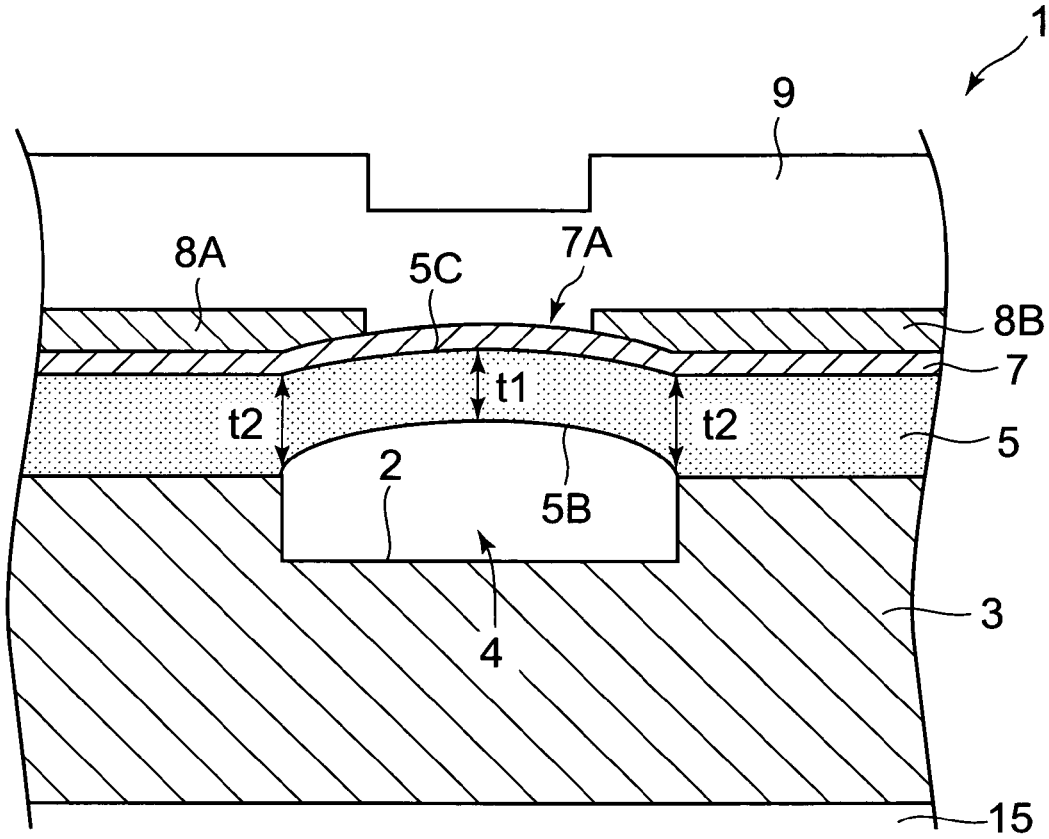
FIG. 3 is a sectional view (longitudinal sectional view) illustrating the thermal head of FIG. 2A taken along the arrow B-B.

The thermal head 1 has a plate shape as illustrated in FIG. 2A. As illustrated in FIG. 2B and FIG. 3, the thermal head 1 includes: a rectangular supporting substrate 3 fixed on the heat dissipation plate 15; a heat storage layer 5 made of thin plate glass (upper substrate, see FIG. 5) 5*a* bonded onto one surface of the supporting substrate 3; a plurality of heating resistors 7 provided on the heat storage layer 5; electrode portions 8A, 8B connected to the heating resistors 7; and a protective film 9 covering the heating resistors 7 and the electrode portions 8A, 8B so as to protect the same from abrasion and corrosion. Note that, an arrow Y of FIG. 2A indicates a feeding direction of the thermal paper 12 by the paper feeding mechanism 17.

The supporting substrate 3 is, for example, an insulating glass substrate having a thickness of approximately 300 μm to 1 mm. On the surface on the heat storage layer 5 side of the supporting substrate 3, there is formed a rectangular concave portion 2 extending in a longitudinal direction. Note that, it is desirable that the supporting substrate 3 be a glass substrate made of the same material as that of the heat storage layer 5, or a glass substrate having similar characteristics.

The heat storage layer 5 is constituted by a thin plate glass 5*a* having a thickness of approximately 0 to 50 μm. The heat storage layer 5 is bonded to one surface of the supporting substrate 3 where the concave portion 2 is formed, in a manner that hermetically seals the concave portion 2. With the heat storage layer 5 covering the concave portion 2, a hollow portion 4 is formed between the heat storage layer 5 and the supporting substrate 3.

The hollow portion 4 functions as a hollow heat insulating layer that prevents heat generated by the heating resistors 7 from entering the supporting substrate 3 from the heat storage layer 5, and has an uninterrupted structure facing all of the heating resistors 7. With the hollow portion functioning as a hollow heat insulating layer, the amount of heat conducted upward above the heating resistors 7 to be used for printing or the like is made larger than the amount of heat conducted to the heat storage layer 5, which is below the heating resistors 7. The heating efficiency can thus be improved.

The heat storage layer 5 has a curved shape that protrudes toward the outside of the hollow portion 4 and rises up toward the heating resistors 7 side. In other words, a surface 5B of the heat storage layer 5 that is on the hollow portion side (hereinafter referred to as "hollow portion side surface") has a concavely curved shape, whereas a surface 5C of the heat storage layer 5 that is on the opposite side from the hollow portion 4 (hereinafter referred to as "heating resistor side surface") has a convexly curved shape. Accordingly, the thickness dimension of the hollow heat insulating layer is larger at a point closer to the center of the concave portion 2 in the width direction than at a point near an edge of the concave portion 2 in the width direction. The heat storage layer 5 is shaped such that a thickness dimension t1 near the center of the concave portion 2 in the width direction is smaller than a thickness dimension t2 near the edge of the concave portion 2 in the width direction.

The heating resistors 7 are each provided so as to straddle the concave portion 2 in its width direction on an upper end surface of the heat storage layer 5, and are arranged at predetermined intervals in the longitudinal direction of the concave portion 2. In other words, each of the heating resistors 7 is provided to be opposed to the hollow portion 4 through an intermediation of the heat storage layer 5 so as to be situated above the hollow portion 4.

The electrode portions 8A, 8B serve to heat the heating resistors 7, and are constituted by a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7, and the individual electrodes 8B are connected to the heating resistors 7, respectively.

When voltage is selectively applied to the individual electrodes 8B, current flows through the heating resistors 7 connected to the selected individual electrodes 8B and the common electrode 8A opposed thereto, whereby the heating resistors 7 are heated. In this state, the thermal paper 12 is pressed by the operation of the pressure mechanism 19 against the surface portion (printing portion) of the protective film 9 covering the heating portions of the heating resistors 7, whereby color is developed on the thermal paper 12 and printing is performed.

Note that, of each of the heating resistors 7, an actual heating portion (hereinafter, referred to as "heating portion 7A") is a portion of each of the heating resistors 7 on which the electrode portions 8A, 8B do not overlap, that is, a portion of each of the heating resistors 7 which is a region between the connecting surface of the common electrode 8A and the connecting surface of each of the individual electrodes 8B and is situated substantially directly above the hollow portion 4. The heating portion 7A is shaped to curve after the shape of the heating resistor side surface 5*c* of the heat storage layer 5 and to rise up toward the protective film 9.

Hereinafter, a manufacturing method A for the thermal head 1 constructed as described above (hereinafter, simply referred to as "manufacturing method A") is described.

Figure 11:
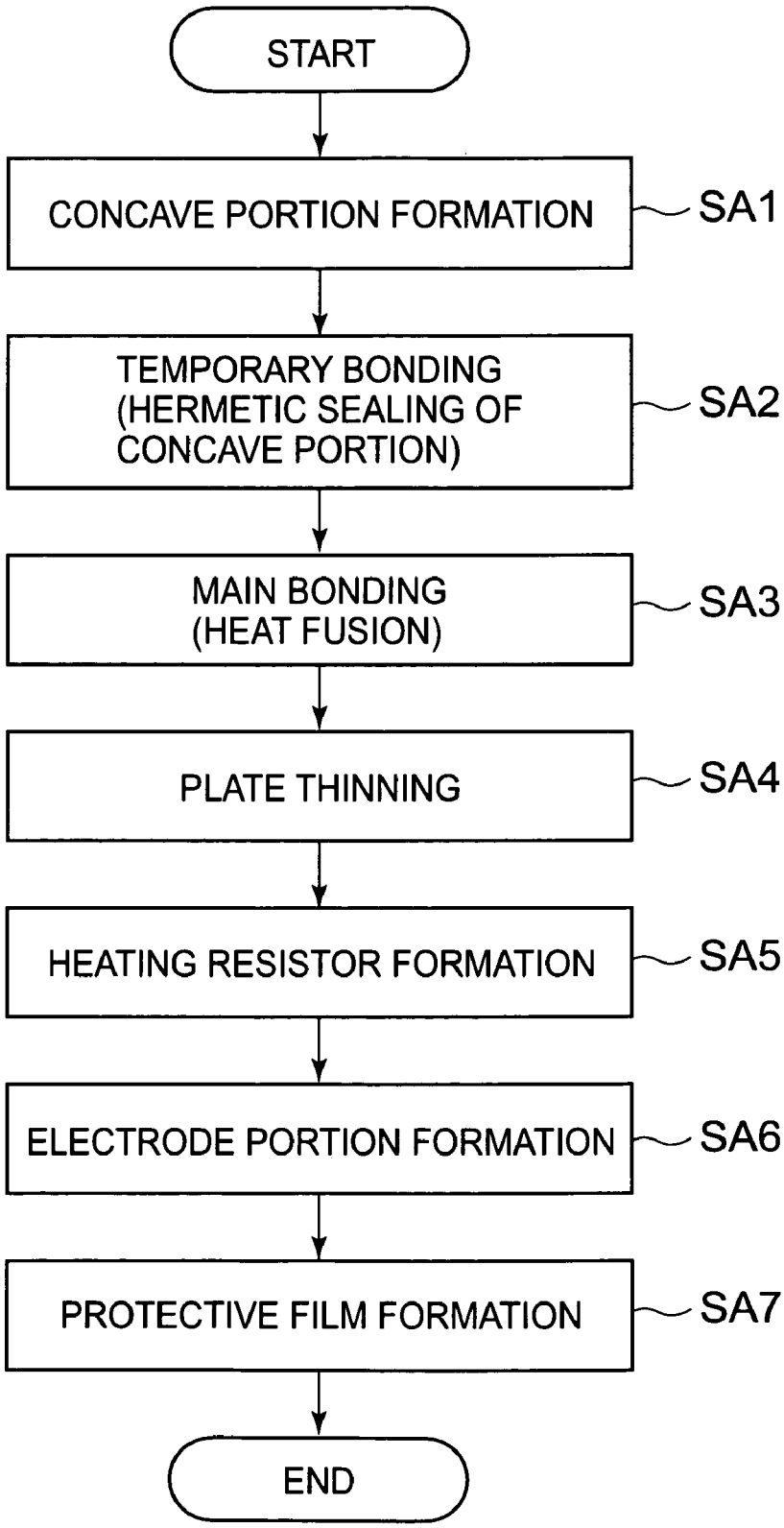
FIG. 11 is a flow chart of the manufacturing method A.

The manufacturing method A according to this embodiment includes a concave portion forming step in which the concave portion 2 is formed on one surface of the supporting substrate 3, a bonding step in which the thin plate glass 5*a* shaped like a substantially flat board is bonded to the one surface of the supporting substrate 3 where the concave portion 2 has been formed, and a heating resistor forming step in which the heating resistors 7 are formed on the thin plate glass Sa. The bonding step includes a temporary bonding step in which the thin plate glass Sa and the supporting substrate 3 are stuck together and a main bonding step in which the thin plate glass Sa and the supporting substrate 3 are fused by heat fusion through heat treatment. A concrete description of these steps is given below with reference to a flow chart of FIG. 11.

Figure 4:
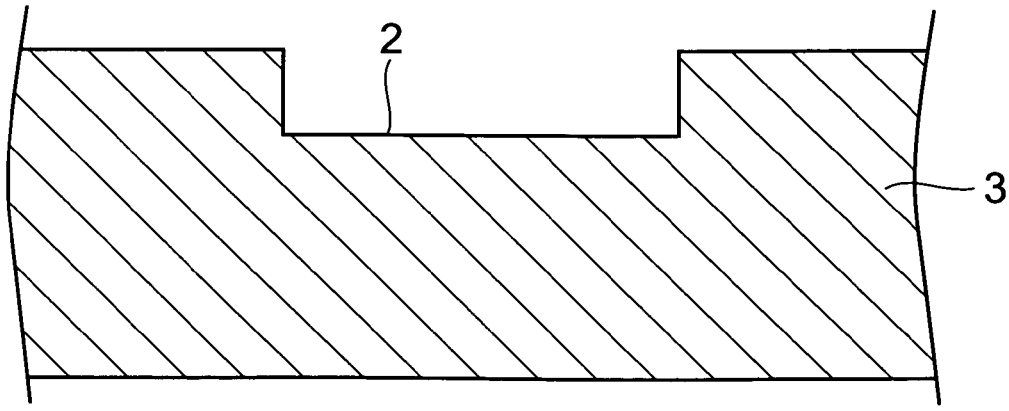
FIG. 4 is a longitudinal sectional view illustrating a state in which a concave portion is formed in a supporting substrate in a manufacturing method A according to the first embodiment of the present invention.

First, as illustrated in FIG. 4, on one surface of the supporting substrate 3, the concave portion 2 is formed so as to be opposed to a region in which the heating resistors 7 are to be formed (Step A1, concave portion forming step). The concave portion 2 is formed by performing, for example, sandblasting, dry etching, wet etching, or laser machining on the one surface of the supporting substrate 3.

When the sandblasting is performed on the supporting substrate 3, the one surface of the supporting substrate 3 is covered with a photoresist material, and the photoresist material is exposed to light using a photomask of a predetermined pattern, whereby there is cured a portion other than the region in which the concave portion 2 is formed.

After that, by cleaning the one surface of the supporting substrate 3 and removing the photoresist material which is not cured, etching masks (not shown) having etching windows formed in the region in which the concave portion 2 is formed can be obtained. In this state, the sandblasting is performed on the one surface of the supporting substrate 3, and the concave portion 2 having a predetermined depth is formed. It is desirable that the depth of the concave portion 2 be, for example, 10 μm or more and half or less of the thickness of the supporting substrate 3.

Further, when etching, such as the dry etching and the wet etching, is performed, as in the case of the sandblasting, the etching masks having the etching windows formed in the region in which the concave portion 2 is formed are formed on the surface of the supporting substrate 3. In this state, by performing the etching on the one surface of the supporting substrate 3, the concave portion 2 having the predetermined depth is formed.

As such an etching process, there are used, for example, the wet etching using hydrofluoric acid-based etchant or the like, and the dry etching such as reactive ion etching (RIE) and plasma etching. Note that, as a reference example, in the case of a single-crystal silicon supporting substrate, there is performed the wet etching using the etchant such as tetramethylammonium hydroxide solution, KOH solution, and mixing solution of hydrofluoric acid and nitric acid.

Figure 5:
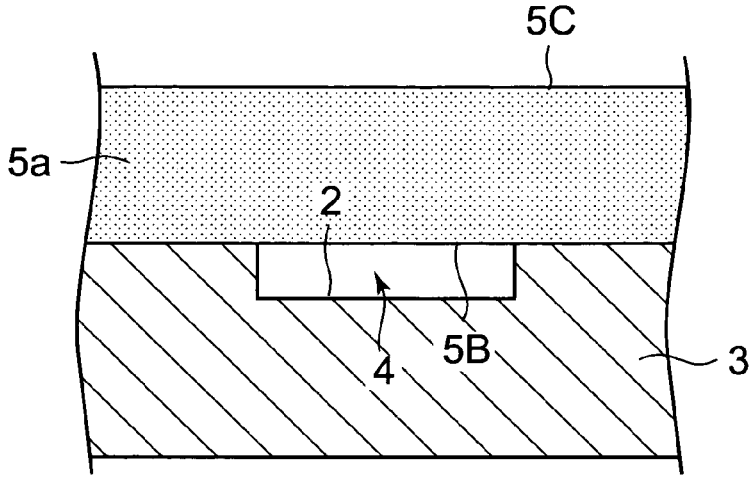
FIG. 5 is a longitudinal sectional view illustrating a state in which thin plate glass is temporarily bonded to the supporting substrate of FIG. 4.

Next, the etching mask is, removed completely from the one surface of the supporting substrate 3 and the surface of the supporting substrate 3 is cleaned. Thereafter, as illustrated in FIG. 5, the thin plate glass 5*a* having a thickness of about 5 μm to 100 μm and shaped like a substantially flat board is bonded to the one surface of the supporting substrate 3 in a manner that hermetically seals the concave portion 2 (Step A2, temporary bonding step). The thin plate glass 5*a* is bonded at room temperature directly to the supporting substrate 3, instead of using an adhesive layer.

The surface of the supporting substrate 3 is covered with the thin plate glass 5*a*, in other words, the opening of the concave portion 2 is covered with the thin plate glass 5*a*, whereby the hollow portion 4 is formed between the supporting substrate 3 and the thin plate glass 5*a*. By the depth of the concave portion 2, it is possible to easily control the thickness of the hollow heat insulating layer.

Figure 6:
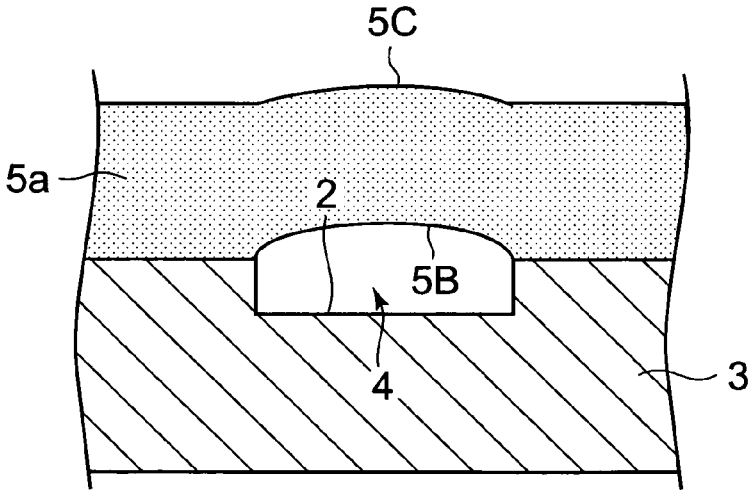
FIG. 6 is a longitudinal sectional view illustrating a state in which the supporting substrate and thin plate glass of FIG. 5 are fused by heat fusion.

Subsequently, as illustrated in FIG. 6, heat treatment is performed on the temporarily bonded supporting substrate 3 and the thin plate glass 5*a* to bond the two by heat fusion (Step A3, main bonding step). The heat treatment is performed at a temperature equal to or higher than the glass transition point of the supporting substrate 3 and the thin plate glass 5*a*, and a temperature equal to or lower than the softening point of the supporting substrate 3 and the thin plate glass 5*a*.

Note that, a glass transition point is a temperature at which the slope of a thermal expansion curve changes rapidly, in other words, a temperature at which a glass structure shifts from a solid state to a liquid state. Further, a softening point is a temperature higher than the glass transition point at which glass starts to soften and deform from its own weight. In the case of a glass fiber, for example, the softening point is a temperature at which the glass fiber starts to lengthen from its own weight. When the glass transition point is exceeded, glass assumes fluidity but softening deformation does not occur around the glass transition point unless some force is applied. Further, when the softening point is exceeded, glass is deformed from its own weight. Accordingly, the precision of glass shape cannot be kept in a temperature range above the softening point due to warping or stretching. This embodiment successfully keeps the precision of the shapes of the supporting substrate 3 and the thin plate glass 5*a* by bonding the two at a temperature equal to or lower than the softening point.

In this case, the heat treatment in the bonding step raises the pressure of gas trapped inside the hollow portion 4. A force applied to the thin plate glass 5*a* in a direction in which the gas expands causes softening deformation. The expansion of the gas within the hollow portion 4 and the softening of the thin plate glass 5*a* during the heat fusion results in plastic deformation that causes the thin plate glass 5*a* to protrude toward the outside of the hollow portion 4. Thus, the thickness dimension of the hollow heat insulating layer is increased and the heat insulation performance is improved compared to the case where the hollow portion side surface 5B of the thin plate glass 5*a* is flat.

In addition, the use of the thin plate glass 5*a* shaped like a substantially flat board makes it possible to apply a substantially uniform load to the heating resistor side surface 5C upon bonding. This eliminates the inconvenience of conventional upper substrates having a convex portion on their heating resistor side surfaces in which the convex portion is deformed from a load applied upon bonding to cause fluctuations in the shape of the heating resistor side surface. It is therefore easy to set the heat storage layer 5 to a desired thickness.

Figure 7:
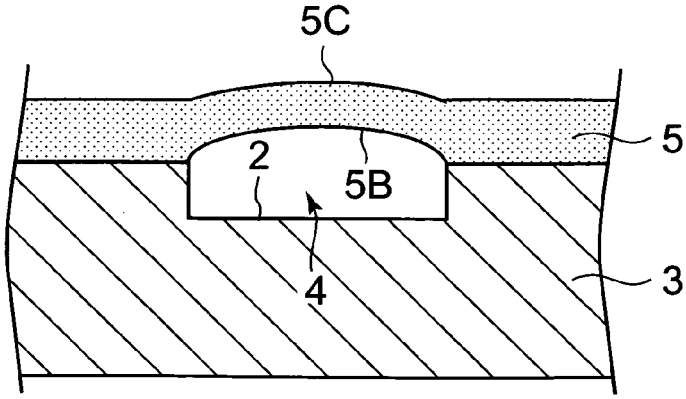
FIG. 7 is a longitudinal sectional view illustrating a state in which the thin plate glass of FIG. 6 is thinned to form a heat storage layer.

Here, it is difficult to manufacture and handle a thin plate glass having a thickness of 100 μm or less, and such a thin plate glass is expensive. Thus, instead of directly bonding an originally thin plate glass onto the supporting substrate 3, the thin plate glass 5*a* having the thickness allowing easy manufacture and handling thereof may be bonded onto the supporting substrate 3, and then, the thin plate glass 5*a* may be additionally processed by the etching, the polishing, or the like so that the thin plate glass 5*a* has a desired thickness (Step A4, thinning step). With this process, as illustrated in FIG. 7, it is possible to easily form the extremely thin heat storage layer 5 over the one surface of the supporting substrate 3 at low cost.

Note that, as the etching of the thin plate glass 5*a*, there can be used various types of etching adopted for forming the concave portion 2 as described above. Further, as the polishing of the thin plate glass 5*a*, for example, there can be used chemical mechanical polishing (CMP) which is used for high-accuracy polishing of a semiconductor wafer and the like.

Figure 8:
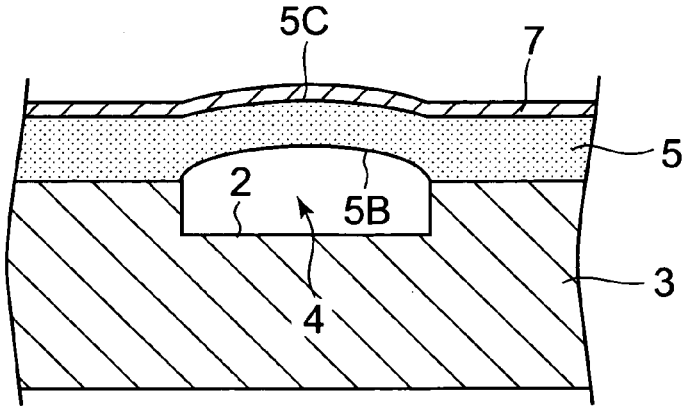
FIG. 8 is a longitudinal sectional view illustrating a state in which a heating resistor is formed on the heat storage layer of FIG. 7.
Figure 9:
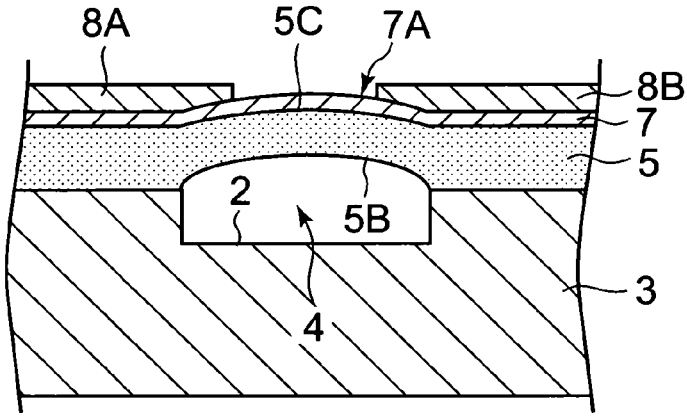
FIG. 9 is a longitudinal sectional view illustrating a state in which electrode portions are formed on the heating resistor of FIG. 8.
Figure 10:
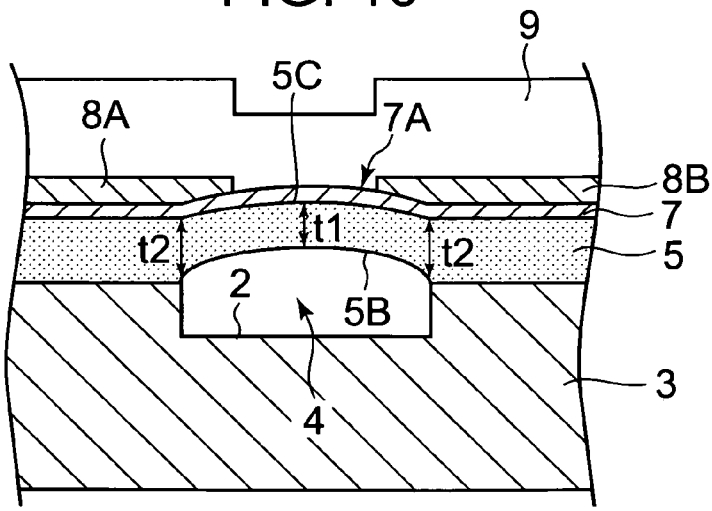
FIG. 10 is a longitudinal sectional view illustrating a state in which a protective film is formed on the electrode portions of FIG. 9.

Next, as illustrated in FIGS. 8 to 10, the heating resistors 7, the common electrode 8A, the individual electrodes 8B, and the protective film 9 are subsequently formed on the heat storage layer 5 (heating resistor forming step and the like). The heating resistors 7, the common electrode 8A, the individual electrodes 8B, and the protective film 9 can be manufactured by using a well-known manufacturing method for a conventional thermal head.

First, in the heating resistor forming step, a thin film is formed from a heating resistor material such as a Ta-based material or a silicide-based material on the heat storage layer 5 by a thin film forming method such as sputtering, chemical vapor deposition (CVD), or vapor deposition. The thin film of a heating resistor material is molded by lift-off, etching, or the like to form the heating resistors 7 having a desired shape as illustrated in FIG. 8 (Step A5, heating resistor forming step). Specifically, the heating portion 7A of each of the heating resistors 7 is curved after the shape of the heating resistor side surface 5C of the heat storage layer 5, so that the heating portion 7A has a convexly rising shape. This way, a better contact with the thermal paper 12 is accomplished and the heat transmission efficiency is enhanced.

Subsequently, as in the heating resistor forming step, the film formation with use of a wiring material such as Al, Al—Si, Au, Ag, Cu, and Pt is performed on the heat storage layer 5 by using sputtering, vapor deposition, or the like. Then, the film thus obtained is formed by lift-off or etching, or the wiring material is screen-printed and is, for example, burned thereafter, to thereby, as illustrated in FIG. 9, form the common electrode 8A and the individual electrodes 8B which have the desired shape (Step A6). Note that, the heating resistors 7, the common electrode 8A, and the individual electrodes 8B are formed in an appropriate order.

In the lift-off for the heating resistors 7 and the electrode portions 8A, 8B or in the patterning of a resist material for the etching, the patterning is performed on the photoresist material by using a photomask.

After the formation of the heating resistors 7, the common electrodes 8A, and the individual electrodes 8B, the film formation with use of a protective film material such as $SiO_2$, $Ta_2O_5$, SiAlON, $Si_3N_4$, or diamond-like carbon is performed on the heat storage layer 5 by sputtering, ion plating, CVD, or the like, whereby, as illustrated in FIG. 10, the protective film 9 is formed (Step A7). Thus, the thermal head 1 illustrated in FIG. 2A is manufactured.

As has been described, the thermal printer 10 and the thermal head 1 according to this embodiment are increased in the thickness dimension of the hollow heat insulating layer and accordingly improved in heat insulation performance by giving the hollow portion 4, that is, the hollow portion side surface 5B of the thin plate glass 5*a*, which forms the hollow heat insulating layer, a convexly curved shape. The heating efficiency of the thermal head 1 is thus improved and the thermal printer 10 consumes less power when printing on a printing material.

With the manufacturing method A according to this embodiment, the use of the thin plate glass 5*a* shaped like a substantially flat board makes it easier to set the heat storage layer 5 to a desired thickness and reduces fluctuations in the thickness of the heat storage layer 5, compared to conventional upper substrates which have a convex portion on their heating resistor side surfaces. This substantially uniformizes the contact pressure between the heating resistors 7 and the thermal paper 12, thus making excellent quality printing possible with low power. Further, heat fusion in the bonding step utilizes the expansion of gas trapped inside the hollow portion 4 and the softening of the thin plate glass 5*a*, and hence there is no need for an additional step of curving a surface of the thin plate glass 5*a*. The thermal head 1 improved in heating efficiency and strength can therefore be manufactured in a simple and stable manner.

Glass is superior in surface flatness and smoothness compared to dielectric dry film sheets, which are thermally curable, and superior in mechanical strength compared to epoxy resin dry film sheets. The thin plate glass 5*a* therefore makes the heat storage layer 5 that has excellent reliability and durability. In addition, glass hardly changes in mechanical and chemical properties from heat treatment at a temperature equal to or lower than the softening point, and does not change in shape unless a heavy load is applied, which means that the thickness of the heat storage layer 5 changes little upon bonding. The thickness of the heat storage layer 5*a* can therefore be controlled with higher precision compared to when a dielectric dry film sheet or an epoxy resin dry film sheet is used which shrinks from heat treatment and becomes thinner than its initial thickness after the heat treatment. The use of glass also allows the heat storage layer 5 to be thinned by wet etching or the like, or to be increased in film thickness by forming a film, after the bonding. Further, the supporting substrate 3 and the thin plate glass 5*a* can be bonded by heat fusion without applying any other load to the thin plate glass 5*a* than its own weight. This eliminates the need for an apparatus that applies a load such as a pressing machine, unlike dielectric dry film sheets and epoxy resin dry film sheets which require a heavy load to bond with a substrate, and the bonding step can be carried out with a simple equipment that includes only a heat treatment furnace and a few others.

This embodiment can be modified as follows.

For example, in contrast to this embodiment where the thin plate glass 5*a* is simply bonded under the application of a load to the supporting substrate 3 at a temperature equal to or higher than the glass transition point and equal to or lower than the softening point, a first modification example may include applying a load during a period in which the temperature is equal to or lower than the glass transition point, subsequently lifting the load and, in this state, raising the temperature to a set temperature which is equal to or lower than the softening point, and then cooling until room temperature is reached again. This way, the bonding strength is enhanced while the thin plate glass 5*a* is deformed so as to protrude toward the outside of the hollow portion 4.

Figure 12A:
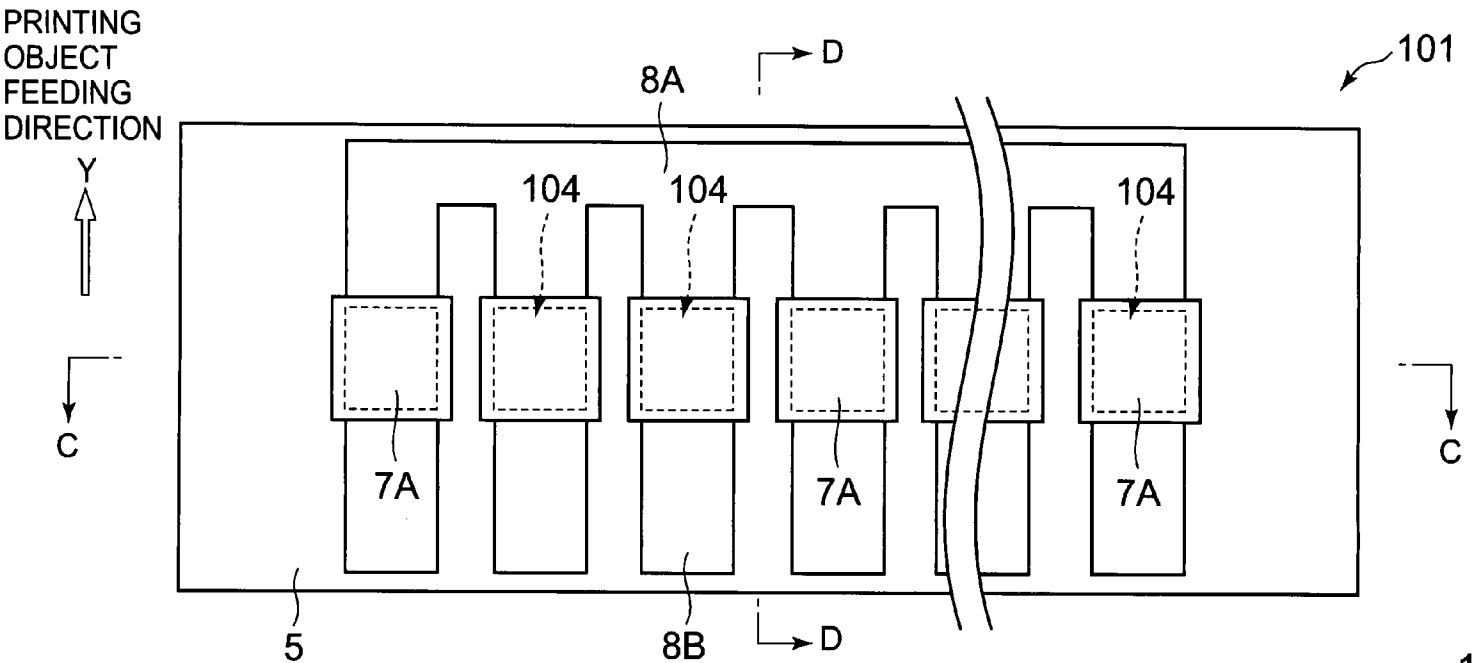
FIG. 12A is a plane view of a thermal head according to a second modification example of the first embodiment of the present invention as seen from the protective film side.
Figure 12B:
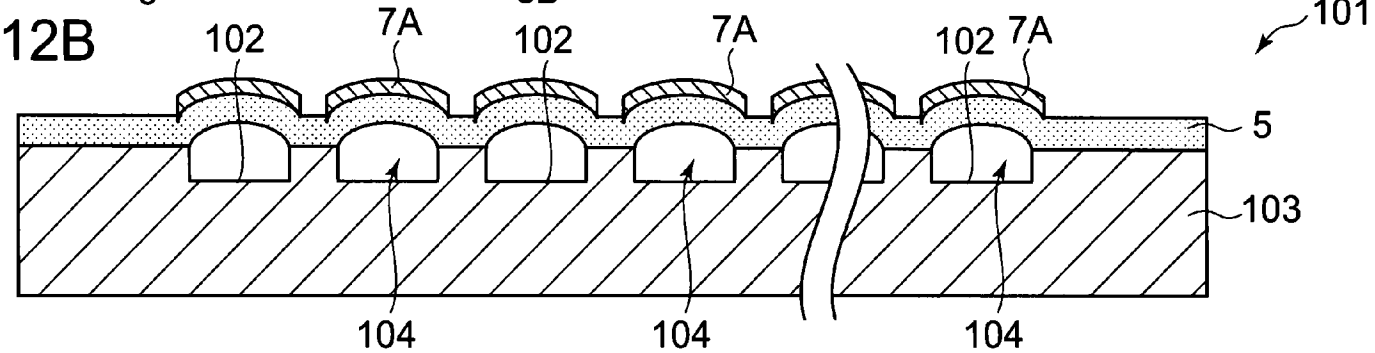
FIG. 12B is a sectional view of the thermal head of FIG. 12A taken along the arrow C-C.

A thermal head 101 according to a second modification example may be, for example, as illustrated in FIGS. 12(*a*) and 12(*b*), where a concave portion 102 is formed in each region of a supporting substrate 103 that faces one of the heating resistors 7, so that an individual hollow portion 104 is provided for each of the heating resistors 7. This way, the heat storage layer 5 is supported by the supporting substrate 103 at short distance intervals. Compared to the hollow portion 4 which has an uninterrupted structure facing all of the heating resistors 7, the hollow portions 104 enhance the strength against external load of the heat storage layer 5 which supports the heating resistors 7.

Second Embodiment

A thermal head 201 according to a second embodiment of the present invention, and a manufacturing method B of the thermal head 201 as well, are described below with reference to the drawings.

Figure 13:
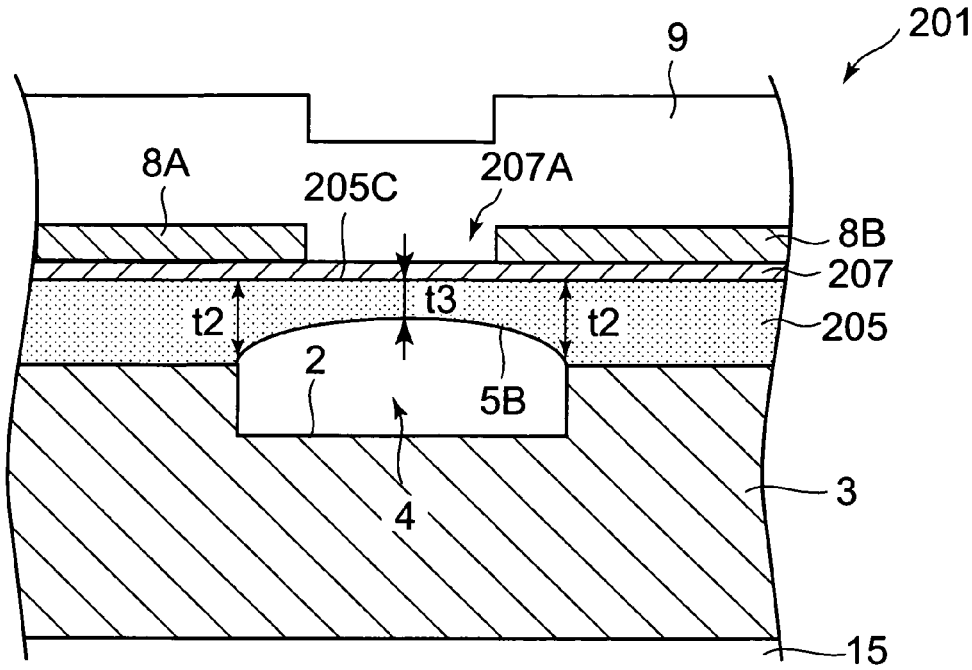
FIG. 13 is a sectional view of the thermal head of FIG. 12A taken along the arrow D-D.

The thermal head 201 according to this embodiment differs from the first embodiment in that a heating resistor side surface 205C of a heat storage layer 205 is flat as illustrated in FIG. 13.

In the following description of this embodiment, components common to the thermal head 1 and thermal head manufacturing method A of the first embodiment are denoted by the same reference numerals and symbols in order to omit repetitive descriptions.

The heat storage layer 205 includes a hollow portion side surface 5B which is concavely curved and the heating resistor side surface 205C which is substantially flat.

A heating portion 207A of each heating resistor 207 has a substantially flat shape which takes after the shape of the heating resistor side surface 205C of the heat storage layer 205.

The manufacturing method B of the thus structured thermal head 201 is described below.

Figure 14:
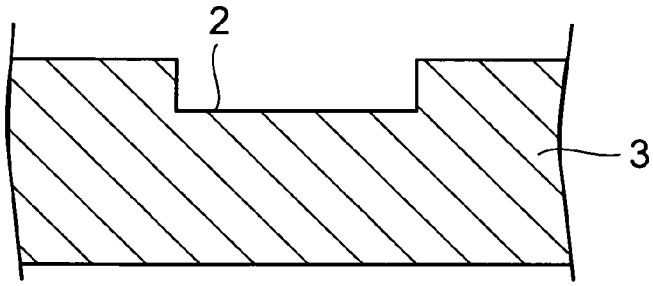
FIG. 14 is a longitudinal sectional view illustrating a state in which a concave portion is formed in a supporting substrate in a manufacturing method B according to a second embodiment of the present invention.
Figure 15:
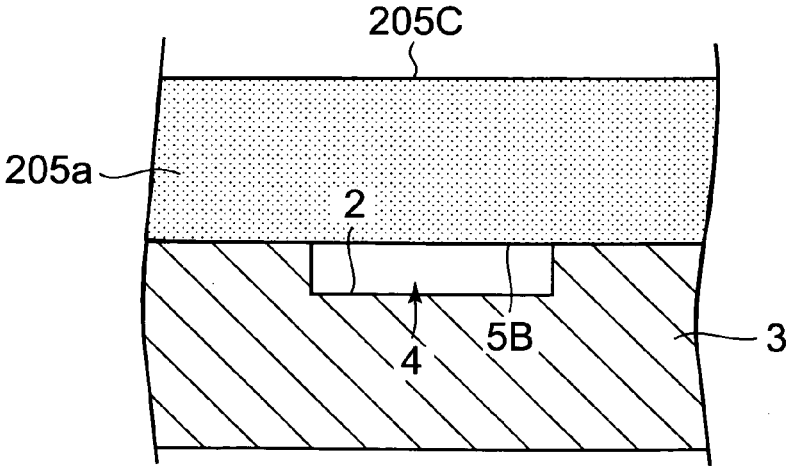
FIG. 15 is a longitudinal sectional view illustrating a state in which thin plate glass is temporarily bonded to the supporting substrate of FIG. 14.
Figure 16:
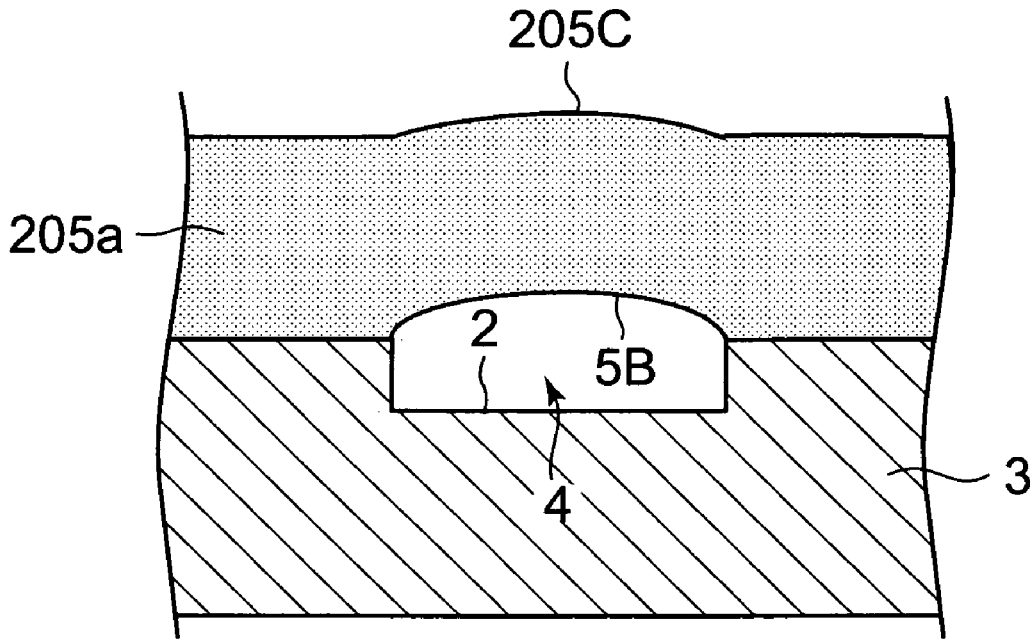
FIG. 16 is a longitudinal sectional view illustrating a state in which the supporting substrate and thin plate glass of FIG. 15 are fused by heat fusion.
Figure 18:
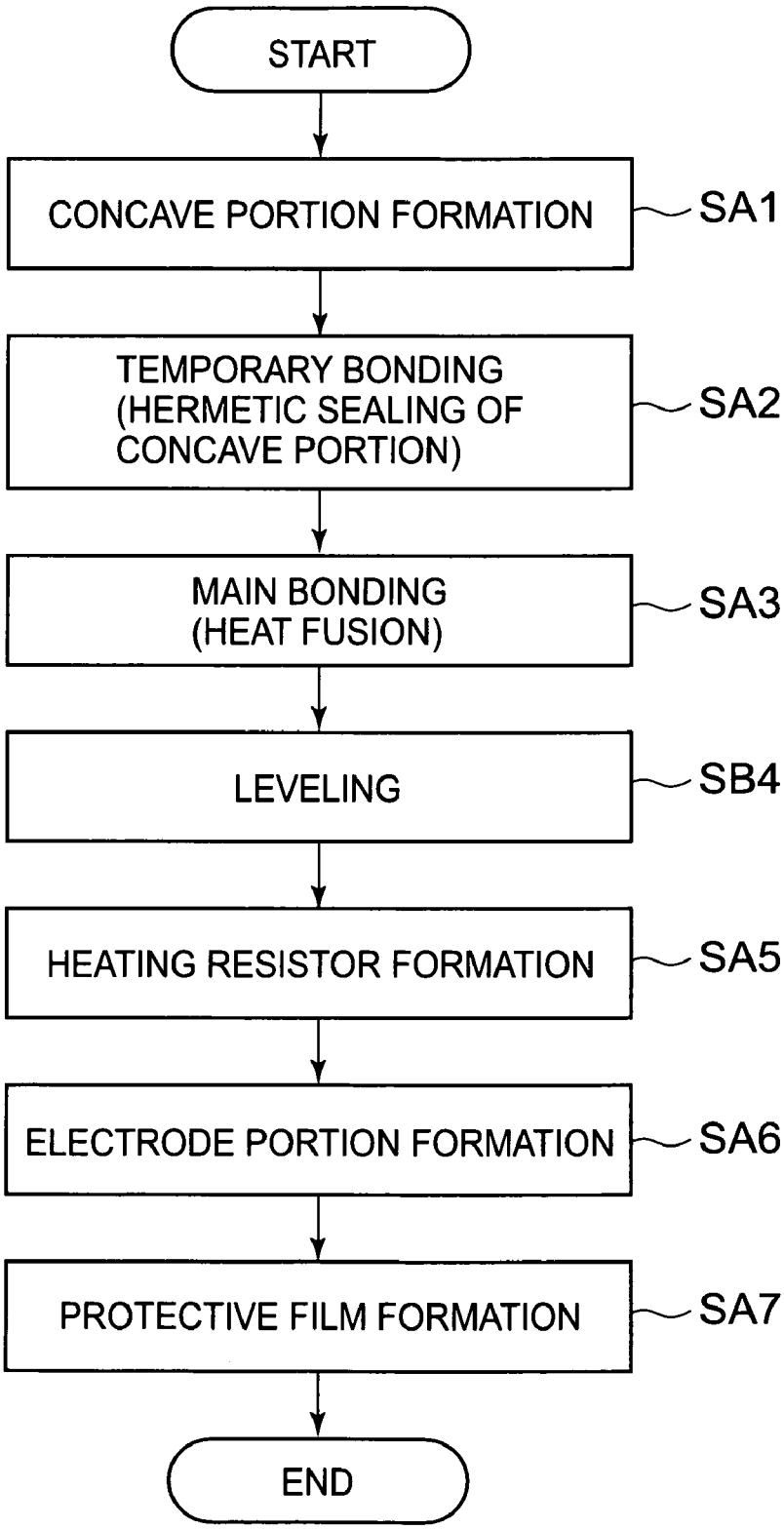
FIG. 18 is a flow chart of the manufacturing method B.

The manufacturing method B includes, as illustrated in a flow chart of FIG. 18, a leveling step in place of the plate thinning step of the manufacturing method A. The leveling step is for leveling the heating resistor side surface 205C of a thin glass plate 205*a* which has been deformed by plastic deformation in a bonding step. A concave formation step, a temporary bonding step, a main bonding step (Steps A1 to A3, see FIGS. 14 to 16), and a heating resistor forming step and subsequent steps (Steps A5 to A7) in the manufacturing method B are the same as those in the manufacturing method A of the first embodiment.

Figure 17:
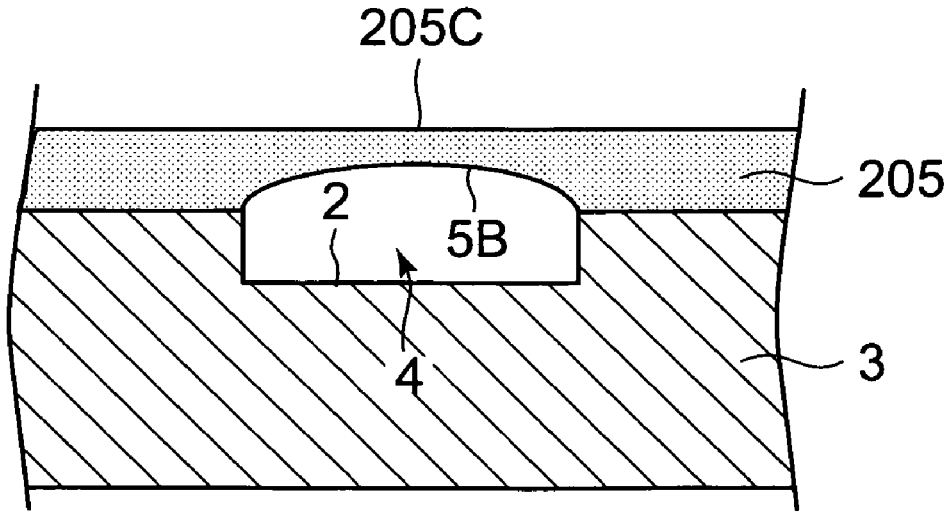
FIG. 17 is a longitudinal sectional view illustrating a state in which the thin plate glass of FIG. 16 is thinned to form a heat storage layer.

In the leveling step, the heating resistor side surface 205C of the thin plate glass 205*a* is leveled by polishing, and, as illustrated in FIG. 17, processed so that the heat storage layer 205 has a desired thickness dimension (Step B4, leveling step).

With the manufacturing method B where the heating resistor 207 is formed on the leveled thin plate glass 205*a* in the heating resistor forming step, it is easy to form the heating portion 207A into a flat shape. Further, by giving the heating portion 207A a substantially flat shape, friction with the thermal paper 12 is reduced. The amount of wear of the heating portion 207A is thus reduced and the durability is improved while high heat insulation performance is maintained. In addition, compared to the case where the heating resistor side surface 205C is curved convexly, a thickness dimension t3 near the center of the concave portion 2 in the width direction is reduced further and the heating efficiency is enhanced even more.

This embodiment can be modified as follows.

For example, the manufacturing method B where the heating resistor side surface 205C of the thin plate glass 205*a* is leveled in the leveling step may be changed into a manufacturing method C which, instead of having the leveling step, controls the deformation of the heating resistor side surface 205C of the thin plate glass 20Sa during the heat fusion in the bonding step.

Figure 19:
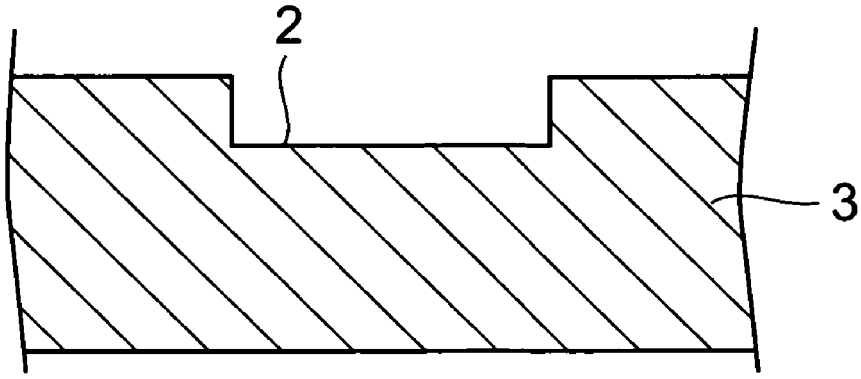
FIG. 19 is a longitudinal sectional view illustrating a state in which a concave portion is formed in a supporting substrate in a manufacturing method C according to a modification example of the second embodiment of the present invention.
Figure 20:
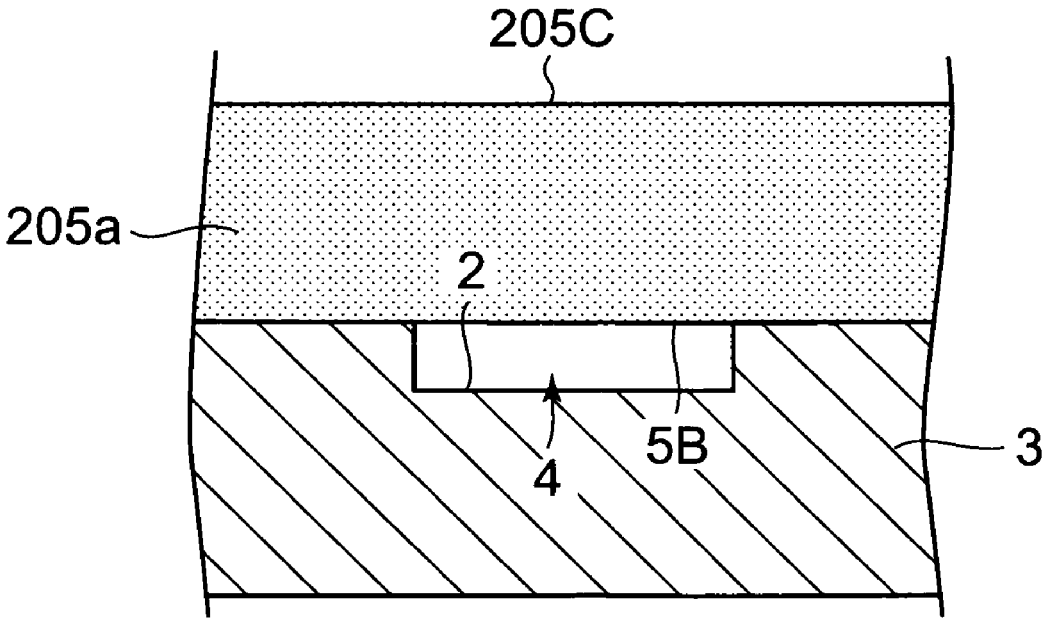
FIG. 20 is a longitudinal sectional view illustrating a state in which thin plate glass is temporarily bonded to the supporting substrate of FIG. 19.
Figure 21:
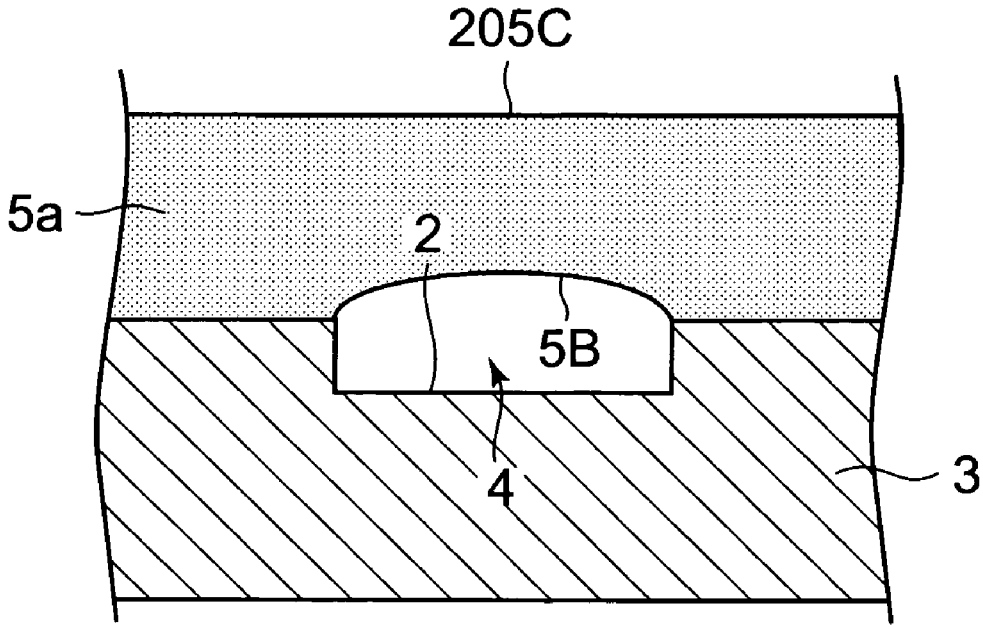
FIG. 21 is a longitudinal sectional view illustrating a state in which the supporting substrate and thin plate glass of FIG. 20 are fused by heat fusion.
Figure 22:
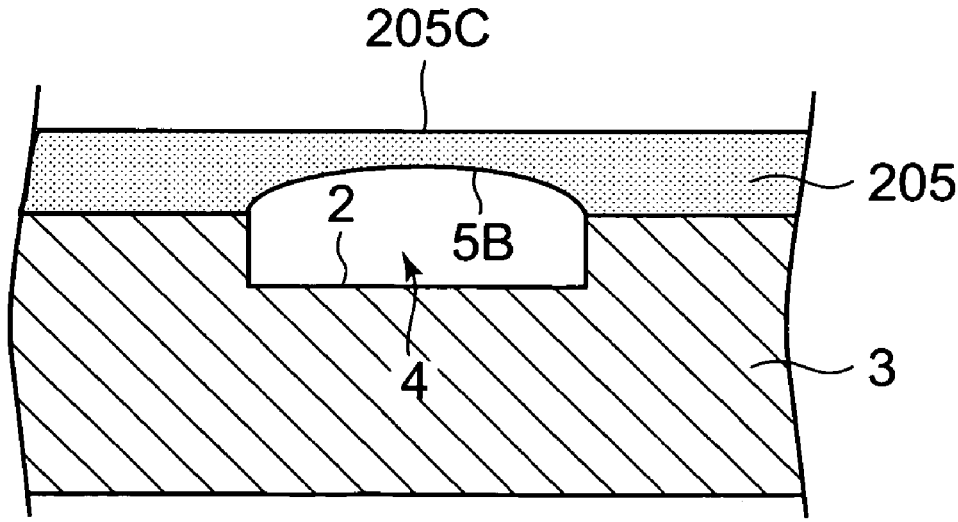
FIG. 22 is a longitudinal sectional view illustrating a state in which the thin plate glass of FIG. 21 is thinned to form a heat storage layer.

Specifically, the manufacturing method C may include executing the concave portion forming step (see FIG. 19) and the temporary bonding step (see FIG. 20) and, in the subsequent main bonding step, heating the thin plate glass 205*a* at a temperature equal to or higher than the glass transition point and equal to or lower than the softening point while applying a substantially uniform load to the heating resistor side surface 205C of the thin plate glass 205*a*, to thereby fuse the supporting substrate 3 and the thin plate glass 205*a* together by heat fusion. This way, as illustrated in FIG. 21, the hollow portion side surface 5B of the thin plate glass 205*a* is curved concavely through substrate deformation upon heat treatment, whereas the heating resistor side surface 205C is leveled by the load applied to the thin plate glass 205*a*. A step of leveling the heating resistor side surface 205C can thus be omitted. A plate thinning step (see FIG. 22) may be conducted subsequently.

Embodiments of the present invention have been described in detail with reference to the drawings. However, concrete structures of the present invention are not limited to the embodiments and include a design modification and the like that do not depart from the spirit of the present invention.

For example, while the shape of the thin plate glass 5*a* or 205*a* shaped like a substantially flat board is deformed in the bonding step of the above-described manufacturing methods A, B, and C, the step of bonding the thin plate glass 5*a* or 205*a* to the supporting substrate 3 and the step of deforming the thin plate glass 5*a* or 205*a* may be separate steps.

Specifically, a manufacturing method D includes a bonding step in which the thin plate glass 5*a* or 205*a* is bonded to one surface of the supporting substrate 3 or 103 where the concave portion 2 has been formed in a concave portion forming step, and hence the concave portion 2 is hermetically sealed forming the hollow portion 4, and a heating step in which the supporting substrate 3 or 103 and thin plate glass 5*a* or 205*a* bonded together in the bonding step are heated to soften the thin plate glass 5*a* or 205*a* as well as to expand gas trapped inside the hollow portion 4. The thin plate glass 5*a* or 205*a* may be deformed in the heating step.

For instance, the thin plate glass 5*a* or 205*a* may be deformed by plastic deformation so as to protrude toward the outside of the hollow portion 4, or may be deformed by plastic deformation in a manner that makes the heating resistor side surface 5C or 205C substantially flat while curving the hollow portion side surface 5B concavely. Further, the manufacturing method D may include a leveling step, or, instead of including a leveling step, may control the deformation of the heating resistor side surface 205C during the heat fusion in the bonding step. In this modification example, direct bonding by heat fusion may be replaced by bonding of the supporting substrate 3 or 103 and the thin plate glass 5*a* or 205*a* with the use of an adhesive layer.

What is claimed is:

1. A thermal head manufacturing method, comprising:

a concave portion forming step of forming a concave portion on one surface of a supporting substrate;

a bonding step of bonding an upper substrate, which is made of glass shaped like a substantially flat board, to the one surface of the supporting substrate where the concave portion has been formed in the concave portion forming step, in a manner that hermetically seals the concave portion and forms a hollow portion;

a heating step of heating the supporting substrate and the upper substrate which have been bonded together in the bonding step, to thereby soften the upper substrate and expand gas trapped inside the hollow portion to cause the upper substrate to be deformed by plastic deformation so as to rise up toward an opposite side from the hollow portion;

a leveling step of leveling a surface of the upper substrate which has been deformed by plastic deformation in the heating step that is opposite from the hollow portion; and a heating resistor forming step of forming a heating resistor on the upper substrate so as to be opposed to the hollow portion, wherein the heating step concavely curves a surface of the upper substrate that is on the hollow portion side.

2. A thermal head manufacturing method, comprising:

a concave portion forming step of forming a concave portion on one surface of a supporting substrate;

a bonding step of bonding by heat fusion an upper substrate, which is made of glass shaped like a substantially flat board, to the one surface of the supporting substrate where the concave portion has been formed in the concave portion forming step, in a manner that hermetically seals the concave portion and forms a hollow portion and that causes the upper substrate to be deformed by plastic deformation so as to rise up toward an opposite side from the hollow portion;

a leveling step of leveling a surface of the upper substrate which has been deformed by plastic deformation in the bonding step that is opposite from the hollow portion; and a heating resistor forming step of forming a heating resistor on the upper substrate so as to be opposed to the hollow portion, wherein the bonding step concavely curves a surface of the upper substrate that is on the hollow portion side by utilizing expansion of gas trapped inside the hollow portion and softening of the upper substrate during the heat fusion.

3. A thermal head, comprising:

a supporting substrate which has a concave portion on a surface;

an upper substrate made of glass which is bonded to the surface of the supporting substrate to hermetically seal the concave portion and form a hollow portion; and a heating resistor which is provided on the upper substrate so as to be opposed to the hollow portion, wherein the upper substrate comprises a hollow portion side surface, which is deformed from a substantially flat shape into a concavely curved shape by expansion of gas within the hollow portion and softening of the upper substrate from heating, and a heating resistor side surface, which is made substantially flat.

4. A printer, comprising:

the thermal head according to claim 3; and a pressurizing mechanism which presses an object to be printed against the heating resistor of the thermal head.

* * * * *